United States Patent [19]

Dardick

[11] 4,026,212

[45] May 31, 1977

[54] OPEN CHAMBER GAS POWERED TOOL AND GAS GENERATING CHARGE THEREFOR

[76] Inventor: David Dardick, 500 Via del Monte, Palos Verdes Estates, Calif. 90274

[22] Filed: Apr. 23, 1975

[21] Appl. No.: 570,909

Related U.S. Application Data

[63] Continuation of Ser. No. 359,754, May 14, 1973, abandoned.

[52] U.S. Cl. ..... 102/39; 89/35 R; 102/86.5

[51] Int. Cl.[2] ..... F42B 3/04

[58] Field of Search ..... 102/38, 39, 45 R, 86.5; 89/35 R, 35 A, 29; 227/11

[56] References Cited

UNITED STATES PATENTS

| | | | |
|---|---|---|---|
| 3,328,963 | 7/1967 | Kraus | 89/29 |
| 3,424,087 | 1/1969 | Hintze | 102/39 |
| 3,433,156 | 3/1969 | Suzuki et al. | 102/39 |
| 3,467,276 | 9/1969 | Dardick | 89/35 R |
| 3,492,913 | 2/1970 | Barnard | 89/35 R |
| 3,514,026 | 5/1970 | Dardick | 227/11 |
| 3,572,248 | 3/1971 | Dardick | 102/39 |

*Primary Examiner*—Harold Tudor
*Attorney, Agent, or Firm*—Daniel T. Anderson; Donald R. Nyhagen; Jerry A. Dinardo

[57] ABSTRACT

An open chamber gas powered tool and gas generating charge for the tool. The charge has a hollow open-ended plastic jacket of uniform noncircular cross-section from end to end containing a propellant, such as nitrocellulose, which may be electrically ignited through an open end of the jacket by a spark, hot wire or the like or ignited by detonation of a dab of priming compound contained within a recess in one end of the jacket. The tool has an open chamber breech mechanism including a cylinder containing a firing chamber opening through the cylinder circumference for transporting charges to firing position wherein the chamber is closed by the breech frame, a trigger actuated firing means for firing the charges in firing position, and operating means powered by the gas generated by each fired charge for performing a work function.

The particular tool described is a fastener driving tool having an electrical firing circuit which is conditioned for operation to fire charges by pressing the tool against a workpiece, and a plunger which is propelled through a working stroke by the pressurized gas generated by the fired charges to drive fasteners, such as nails or studs, into the workpiece. The invention also provides a novel method of fabricating and packaging the charges in a magazine with the charges fixed to a web or band for feeding the charges to the tool.

2 Claims, 10 Drawing Figures

OPEN CHAMBER GAS POWERED TOOL AND GAS GENERATING CHARGE THEREFOR

This a continuation of application Ser. No. 359,754, filed May 14, 1973, now abandoned.

BACKGROUND OF THE INVENTION

1. Field of the Invention

This invention relates generally to tools and more particularly to a novel open chamber gas powered tool and a gas generating charge for the tool. The invention relates also to a novel method of fabricating the charge and packaging the charge in a magazine for feeding charges to the tool.

1. Prior Art

As will appear from the ensuring description, the tool and charge of the invention may be adapted to perform various work operations. The particular tool described in a fastener driving tool for driving fasteners, such as nails, studs, and the like, into a workpiece.

Propellant gas powered fastener driving tools are known in the art. One class of such tools fires fasteners into a workpiece at high velocity in much the same way as a gun fires a bullet into a target. Many tools of this class constitute dangerous lethal weapons in that they lack safety means to prevent their firing except when engaged with a workpiece and/or penetration of the fired fasteners completely through the workpiece. There are, of course, tools of this class on the market which do embody safety means for avoiding both of the above stated hazards.

Another disadvantage of many tools of the character described resides in the fact that they embody a closed chamber breech mechanism, that is a breech mechanism having a closed bore-like firing chamber which is completely surrounded circumferentially by a wall. The charges or ammunition to be fired in these tools must be inserted axially into the firing chamber through its breech end and the spent case of each fired charge must be extracted axially through the breech end of the firing chamber. Because of this method of introducing the charges into and extracting the spent cases of the charges from the firing chamber, most tools of this kind are single shot devices which must be reloaded by hand after each shot, thereby rendering use of such tools quite tedious, time consuming, and costly.

Another class of tools which may be used for driving fasteners as well as for other applications are gas powered percussion tools. These tools have a breech mechanism for firing gas generating charges, and a plunger which is propelled through a working stroke by the gas generated by each fired charge. The plunger working stroke may be utilized to drive a fastener, deliver an impact to a workpiece, or perform some other work operation. Examples of tools of this latter class are described in my prior Pat. No. 3,514,026 as well as in U.S. Pat. No. 3,283,657, and British Pat. Nos. 1,036,224 and 1,074,195.

The percussion tool described in my prior U.S. Pat. No. 3,514,026 is an open chamber tool having a forewardly opening cylinder or barrel containing a plunger and an open chamber breech mechanism at the rear end of the barrel in which propellant charges are fired to drive the plunger through a forward working stroke in the barrel. A spring returns the plunger to its normal rearward position in the barrel following each working stroke. The propellant charges which are used in the tool are essentially conventional open chamber ammunition cartridges of the kind described in my prior patents referenced in the above identified tool U.S. Pat. No. 3,514,026 except that the percussion tool charges lack a projectile or bullet. Thus, the propellant charges for my patented percussion tool comprise a plastic open chamber cartridge case or jacket containing a propellant and having a rear end wall. Mounted in this end wall is a primer which is detonated by a trigger actuated hammer on the tool to ignite the propellant and thereby generate high pressure propellant gas for operating the tool.

My patented percussion tool has two distinct advantages. First, relative to its use for driving fasteners, the tool effectively pushes the fasteners into a workpiece with a relatively large force but a relatively low velocity, thereby vertually eliminating the safety hazards associated with the prior high velocity fastener driving tools. Secondly, the open chamber breech permits a relatively simple and low cost tool with a repeater application which is uniquely adapted to a wide variety of high production rate uses, such as driving fasteners in the building construction trade.

SUMMARY OF THE INVENTION

According to one of its important aspects, this invention provides a novel open chamber, gas powered tool and an open chamber gas generating charge for the tool. The charge has a hollow plastic jacket of uniform, noncircular cross-section from end to end containing a central longitudinal propellant chamber which opens through both ends of the jacket. Filling this chamber is a propellant, such as nitrocellulose. In one form of the charge, the propellant is adapted to be electrically ignited through an open end of the jacket by a spark of hot wire. In another form of the charge, one end of the jacket has a recess containing a small dab of priming compound which may be detonated by impact to ignite the propellant. The ends of the propellant chamber may be closed by combustible seals constructed of paper or other flammable material.

The charges may be designed for use in either attached or unattached form. In attached form, the charges are adhesively bonded or otherwise secured to a band or web by which the charges may be fed to the tool. According to a feature of this attached form of charge, the band or web may have flaps along its longitudinal edges which are folded upwardly against and secured to the ends of the jackets of the attached charges to form the propellant chamber end seals of the charges. In unattached form, the charges are handled in a totally separate fashion.

The gas powered tool of the invention has an open chamber breech mechanism in which the charges are fired in firing position by a trigger actuated firing means to generate a pressurized propellant gas, and operating means powered by the gas for performing a selected work operation. The particular tool described, for example, is a percussion tool similar to that of my U.S. Pat. No. 3,514,026 having a plunger which is driven through a forward working stroke by propellant gas pressure to drive a fastener into a workpiece or perform some other work function.

According to one feature of this described tool, its firing means comprises a trigger activated, electrical firing circuit for electrically igniting the propellant of each charge in firing position through the rear open end of the jacket of the charge. According to another feature of the described tool, its firing circuit includes a switch operated by a work engaging means at the forward end of the tool for conditioning the circuit for firing only when the tool is pressed against a workpiece. Under these conditions, the firing circuit may be energized to fire a charge by depressing the trigger of the tool. Removal of the tool from the workpiece deactivates the circuit against being energized by depression of the trigger.

Another aspect of the invention is concerned with the fabrication and packaging of the charges in a magazine to be mounted on the tool for feeding charges in succession to the tool. According to the described fabricating and packing technique, the jackets of the charges are extruded or injection molded and filled with a propellant, such as nitrocellulose, in a moist state. The charges are then placed in a magazine and their propellant is dried by exposure of the magazine to a drying environment, after which the magazine is sealed. This moist propellant handling technique virtually eliminates any possibility of ignition of the propellant during fabrication and packaging.

DESCRIPTION OF THE PREFERRED EMBODIMENTS

Figure 1:
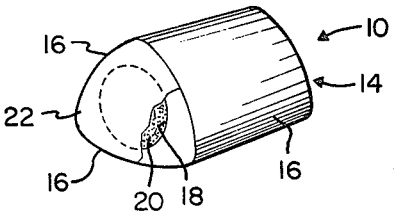
FIG. 1 is a perspective view of a gas generating charge according to the invention.
Figure 2:
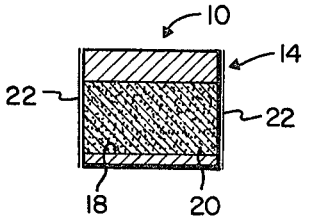
FIG. 2 is a longitudinal section through the charge.
Figure 8:
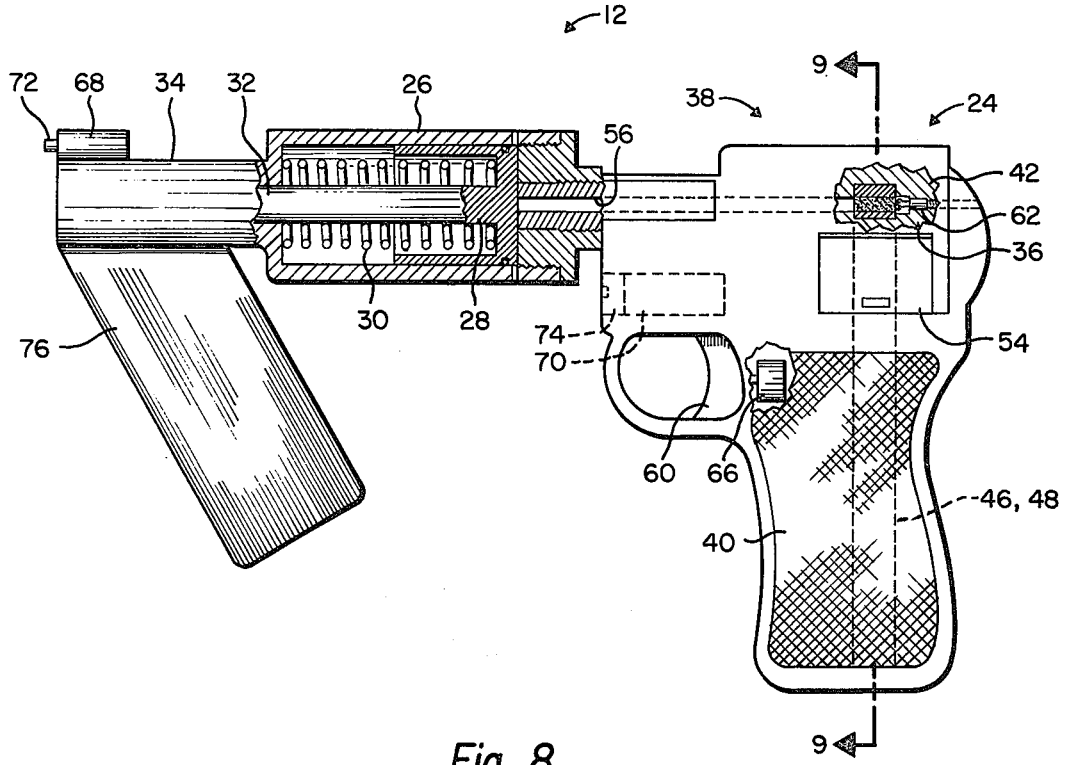
FIG. 8 illustrates a gas powered tool according to the invention.
Figure 9:
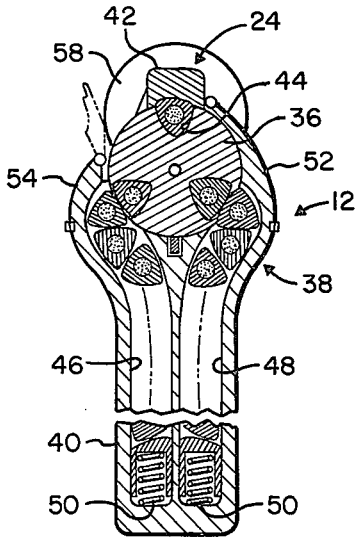
FIG. 9 is a section taken on line 9—9 in FIG. 8.
Figure 10:
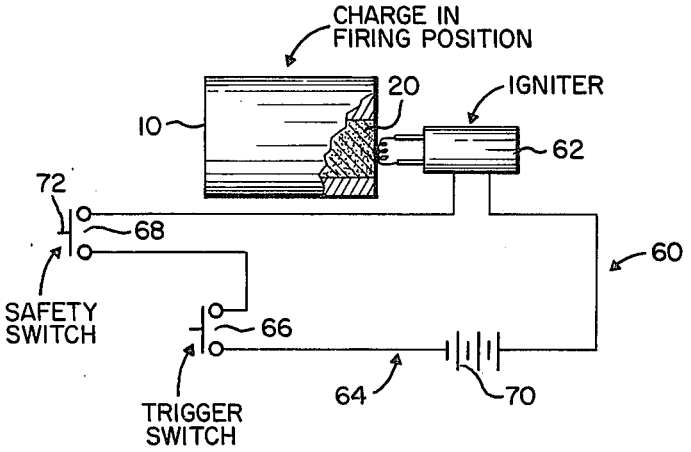
FIG. 10 illustrates the firing means of the tool.

FIGS. 1 and 2 illustrate an open chamber gas generating charge 10 according to the invention for the gas powered open chamber tool 12 of FIGS. 8 through 10. Charge 10 has a hollow plastic jacket 14 of uniform noncircular cross-section suitable for an open chamber breech action. In this instance, the jacket has the preferred generally equilateral triangular cross-section described in my earlier mentioned patents and includes three side walls 16 which are externally cylindrically curved to the same radius. As will appear from the ensuing description, however, an open charge according to the invention may have any other cross-section suitable for an open chamber breech action.

Figure 7:
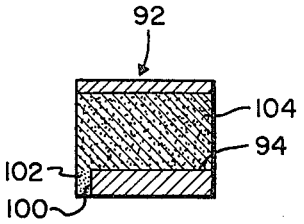
FIG. 7 is a longitudinal section through the modified charge.

Extending longitudinally through the jacket 14, on its central longitudinal axis, is a propellant chamber 18. The illustrated chamber is circular in cross-section, although the chamber may be triangular in cross-section as shown in FIG. 7 or have any other desired cross-section. Propellant chamber 18 opens through the ends of the jacket 14, as illustrated. Filling the propellant chamber is a propellant 20, such as nitrocellulose.

The open ends of the propellant chamber 18 may be left uncovered. Preferably, however, the chamber ends are covered by combustible seals 22 of paper or other flammable material which are adhesively bonded or otherwise secured to the ends of the jacket 14.

As noted above, the gas generating charge 10 is adapted for use in the open chamber gas powered tool 12 of FIGS. 8 through 10. Except for the charge firing means and a fastener magazine embodied in the tool 12, the latter is identical to that described in my earlier mentioned U.S. Pat. No. 3,514,026 which, as noted in the latter patent, embodies a breech mechanism like that of my prior U.S. Pat. No. 2,865,126. Accordingly, it is unnecessary to describe the tool 12 in elaborate detail.

Suffice it to say that the tool has a rear open chamber breech mechanism 24 in which the charges 10 are fired to generate a pressurized propellant gas and a forward cylinder or barrel 26 containing a plunger 28 which is driven through a forward working stroke in the barrel by the propellant gas pressure. A spring 30 returns the plunger to the rear end of its working stroke after firing. Plunger 28 has a forward reduced shank 32 which slides in a forward sleeve portion 34 of the barrel 26. The front end of this sleeve portion is open.

Referring to FIG. 9, the breech mechanism 24 has a breech cylinder 36 rotatable in a breech frame 38 including a handgrip 40 and a firing strap 42. Cylinder 36 contains chambers 44 which open laterally through the cylinder circumference and endwise through the front and rear cylinder ends. These chambers have a cross-sectional shape matching that of the gas generating charge 10. Within the handgrip 40 are magazines 46, 48 for containing a number of the charges 10. The upper ends of these magazines have infeed openings to the cylinder 36 through which the charges are urged against the cylinder by springs 50 in the lower ends of the magazines. The magazines have upper access openings, closed by hinged covers 52, 54 through which the charges 10 are inserted into the magazines.

Each cylinder chamber 44 is rotatable in the direction of the arrow in FIG. 9, through infeed, firing and ejection positions. In infeed position, the chambers register with the infeed openings to the magazines 46, 48, as do the two lower chambers in FIG. 9, to permit infeed movement of charges 10 from the magazines into the chambers, in the manner described in my prior U.S. Pat. No. 2,865,126. Each cylinder chamber 44, when in firing position, is located under and has open side closed by the firing strap 42, as illustrated by the upper chamber in FIG. 9. In this firing position, each cylinder chamber is axially aligned with and opens forwardly to a passage 56 leading to the rear end of the tool plunger barrel 26. Rotation of each chamber 44 from firing to infeed position occurs through the ejection position, wherein the chamber registers with an ejection opening 58 in the breech frame 38.

Embodied in the breech mechanism 24 is a conventional trigger actuated mechanism (not shown) including a trigger 60 for rotating the cylinder 36 stepwise through the cylinder chamber infeed, firing and ejection positions. Each actuation of the trigger 60 rotates one chamber, containing a charge 10, from infeed position to firing position where the charge is fired in the manner to be explained, and another chamber from firing position, through ejection position where the jacket 14 of the fired charge is ejected back to infeed position to receive a fresh charge.

The tool 12 has an electrical firing means 60 for firing the charges 10 in firing position. This firing means includes an electrical propellant igniter 62 mounted in the breech frame 38, at the rear of the breech cylinder 36 and on the axis of the breech passage 56, so as to be disposed in ignition relation to the propellant 20 of a charge located in firing position within a cylinder chamber 44. This igniter is effective, when energized, to ignite the propellant of the charge in firing position through the rear open end of the jacket 14 of the charge. Igniter 62 may be a hot wire, spark gap, or other electrical ignition means capable of igniting the propellant of the charge and, in this description, is assumed to be a hot wire.

The hot wire igniter 62 is energized by a firing circuit 64 including a trigger switch 66, safety switch 68, and battery 70 connected in electrical series with the igniter, as shown in FIG. 10. Trigger switch 66 is a normally open switch which is mounted in the breech frame 38 for closure by depression of the trigger 60 to rotate a breech cylinder chamber 44 to firing position in such a way that the switch closure occurs after arrival of the chamber in firing position. Safety switch 68 is a normally open switch mounted at the front end of the tool barrel 26 and includes a work engaging member 72 projecting forwardly of the barrel. The safety switch is closed by pressing the tool against a workpiece to depress the switch member 72 rearwardly relative to the barrel. Battery 70 is mounted in the breech frame 38 and is accessible for replacement by removing a threaded battery retaining cap 74.

From the description to this point, it will be understood that each actuation or depression of the trigger 60 rotates a breech chamber 44 and its contained gas generating charge 10 to firing position. Assuming that the safety switch 68 is closed by pressing the tool against a workpiece, depression of the trigger also energizes the igniter 62 to fire the charge in firing position by closure of the trigger switch 66. The pressurized gas generated by the fired charge enters the rear end of the tool barrel 26 through the passage 56 and drives the plunger 28 through a forward working stroke in the barrel. After firing, the plunger is returned rearwardly by its spring 30. The plastic jacket 14 of the charge seals the breech during firing. After firing sufficient leakage space exists to permit return of the plunger by its spring.

As understood earlier, the tool of the invention may be designed for various uses. The particular tool shown is a fastener driving tool, specifically a nail driver, mounting on its barrel 26 a replaceable nail magazine 76. This nail magazine feeds a nail to a nail positioning means (not shown) in the barrel in front of the plunger 28 each time the plunger retracts for driving of the nail into a workpiece by the plunger during its next working stroke. This nail magazine and nail positioning means are conventional and hence need not be further described.

Figure 3:
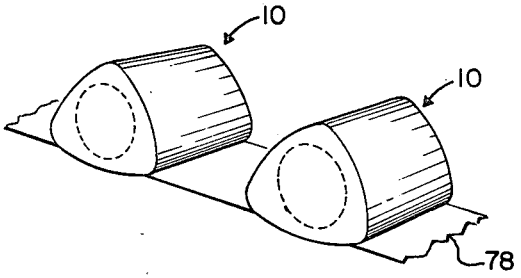
FIG. 3 illustrates belted or attached charges according to the invention.

In some cases, a tool according to the invention may be designed for use with belted or attached gas generating charges. FIG. 3 illustrates such belted charges. In this case, the charge 10 described earlier are adhesively bonded to a feed belt or web 78 constructed of paper or other suitable material. The charges are spaced along the belt in accordance with the circumferential spacing between the breech cylinder chambers of the tool.

Figure 4:
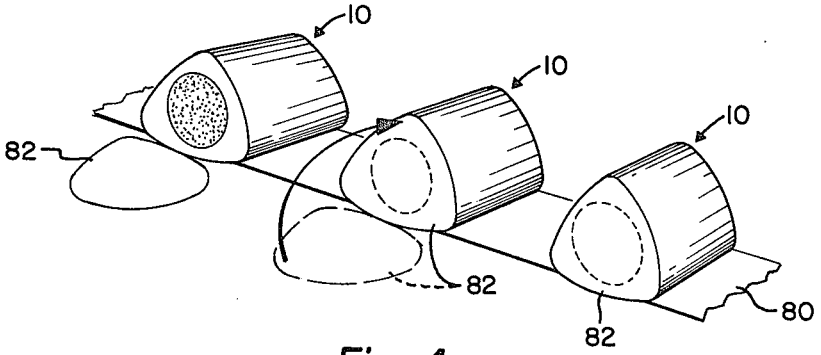
FIG. 4 illustrates a modified version of the belted charges.

As noted earlier, the open ends of the propellant chambers of the charges 10 are preferably closed by seals. FIG. 4 illustrates modified belted charges wherein the feed belt or web 80 has integral flaps 82 along its edges which may be folded against and bonded to the ends of the charges to form the propellant chamber seals.

Figure 5:
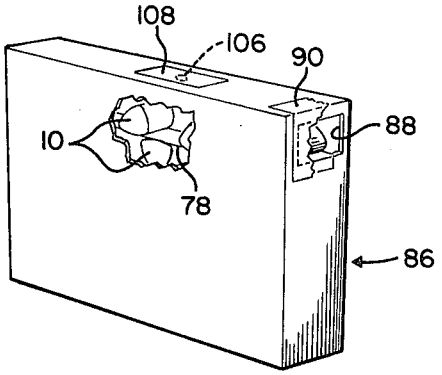
FIG. 5 illustrates a magazine for holding the belted charges.

The belted charges of FIGS. 3 and 4 may be stored in a magazine 86 (FIG. 5) adapted for attachment to a tool. The belted charges may be placed in the magazine in any convenient fashion which permits free withdrawal of the belt 78 or 80 with its attached charges from the magazine through an exit opening 88 in the magazine. This opening may be sealed by a strip of pressure sensitive tape 90 or the like which also anchors the leading end of the belt to permit feeding of the belt into the tool.

Figure 6:
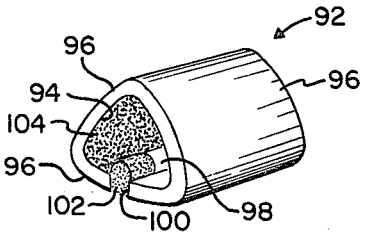
FIG. 6 is a perspective view of a modified charge.

The gas generating charges described above are designed to be fired by an electrical propellant ignition means. FIGS. 6 and 7 illustrates a modified charge 92 which is designed to be fired percussively by a trigger actuated firing pin mechanism or the like. Charge 92 is similar in shape to charge 92 except that its propellant chamber 94 is triangular rather than circular in cross-section. One side wall 96 of charge 92 has an interior longitudinal bead 98 along the center line of the wall and a recess 100 in one end in line with the bead. This recess contains a dab 102 of priming compound which is adapted to be detonated by a firing pin or the like to ignite the main propellant 104 of the charge. Except for this difference in the method of igniting the propellant, the modified charge 92 is used and may be belted in the same manner as the charge 10.

As noted earlier, another aspect of the invention is concerned with the fabrication and packaging of the present gas generating charges. According to the present fabricating and packaging technique, the charges are fabricated and packaged in a storage container, such as magazine 86, all while their propellant is still in moist state and the propellant is then dried in the container after which the latter is hermetically sealed. Fabrication of the charges may be accomplished, for example, by extruding a long tube having the desired cross-section of the charge jackets, filling the tube with propellant in a moist state, and then slicing the tube into individual charges. Alternatively, the jackets may be formed first by extruding and slicing a long tube or by injection molding the jackets, after which the jackets may be filled with the moist propellant. The propellant may be in paste form, in felted form, or in any other suitable form.

After packaging of the charges in the storage container, the propellant is dried by placing the container in a suitable drying atmosphere. The container is provided with one or more vent openings 106 (FIG. 5) to permit escape of the moisture released from the propellant. After drying, the container is hermetically sealed, as by sealing the vent openings with tape 108. This method of handling the charges virtually eliminates any possibility of ignition of the propellant during the fabricating and packaging operations. The storage container will be sized to receive the charges with a close fit in their endwise direction such that even if ignition of the propellant of a charge some how occurs in the container, its jacket will prevent ignition of the other charges.

I claim:

1. An open chamber gas generating charge for an open chamber gas powered tool, comprising:

a plasticly deformable jacket of generally uniform triangular cross-section from end to end having sidewalls which are cylindrically curved about the longitudinal axis of the jacket and containing a propellant chamber of uniform cross-section from end to end extending longitudinally through and opening through the ends of said jacket, said jacket having flat end faces in planes normal to said axis and surrounding the open ends of said chamber;

nitrocellulose filling said chamber; and sheet-thin flammable paper end seals bonded to said jacket end faces and closing the open ends of said chamber, said jacket has a recess entering one end face of the jacket and opening to said propellant chamber; and a priming compound filling said recess.

2. In combination:

a feed belt;

open chamber gas generating charges spaced along said belt;

each charge comprising a plasticly deformable jacket of generally uniform triangular cross-section from end to end having sidewalls which are cylindrically curved about the longitudinal axis of the jacket and containing a propellant chamber of uniform cross-section from end to end extending longitudinally through and opening through the ends of said jacket, said jacket having flat end faces in planes normal to said axis and surrounding the open ends of said chamber, nitrocellulose filling said chamber, and sheet-thin flammable paper end seals bonded to said jacket end faces and closing the open ends of said chamber; and means bonding one sidewall of each charge to the belt, said seals comprise flaps along the longitudinal edges of said belt which are folded against and secured to the ends of said jackets.

* * * * *